US007677904B1

(12) United States Patent
Gao et al.

(10) Patent No.: US 7,677,904 B1
(45) Date of Patent: Mar. 16, 2010

(54) ELECTRICAL CONNECTOR WITH TERMINALS BONDED TO HOUSING

(75) Inventors: Ni Gao, Tu-Cheng (TW); Wei Hong Liao, Tu-Cheng (TW); Ming Chiang Chen, Tu-Cheng (TW)

(73) Assignee: Cheng Uei Precision Industry Co., Ltd., Taipei Hsien (TW)

( * ) Notice: Subject to any disclaimer, the term of this patent is extended or adjusted under 35 U.S.C. 154(b) by 0 days.

(21) Appl. No.: 12/314,287

(22) Filed: Dec. 8, 2008

(51) Int. Cl.
*H01R 12/00* (2006.01)

(52) U.S. Cl. ..... 439/79; 439/736; 439/874

(58) Field of Classification Search ..... 439/79, 439/874, 722, 733.1, 736
See application file for complete search history.

(56) References Cited

U.S. PATENT DOCUMENTS 3,862,791 A * 1/1975 Miller ..... 29/868
6,206,735 B1 * 3/2001 Zanolli ..... 439/736
6,371,771 B1 * 4/2002 Fan ..... 439/79
6,444,911 B2 * 9/2002 Maruyama et al. ..... 174/70 B
6,855,013 B2 * 2/2005 Chiang et al. ..... 439/862

* cited by examiner

*Primary Examiner*—Tho D Ta
(74) *Attorney, Agent, or Firm*—Rosenberg, Klein & Lee

(57) ABSTRACT

An electrical connector includes an insulating housing and a plurality of electric terminals. The insulating housing defines a plurality of terminal grooves for correspondingly receiving the electric terminals therein. Each of the electric terminals has a welded portion extending outside from a rear of the insulating housing for being soldered to a printed circuit board. A substantially inversed funnel shaped injecting portion is formed at a middle portion of the welded portion for leading liquid-state material to inject therefrom and then flow to the welded portion until the liquid-state material is solidified and integrated with the insulating housing. Therefore, the welded portions are not easily warped while soldered to the printed circuit board. Thus, the welded portions are soldered to the printed circuit board firmly, and the electrical connection between the electrical connector and the printed circuit board is more stable.

9 Claims, 4 Drawing Sheets

ELECTRICAL CONNECTOR WITH TERMINALS BONDED TO HOUSING

BACKGROUND OF THE INVENTION

1. Field of the Invention

The present invention relates to an electrical connector, and more particularly to an electrical connector capable of being connected with a printed circuit board stably.

2. The Related Art

A conventional electrical connector capable of being connected with a printed circuit board includes an insulating housing and a plurality of terminals. The insulating housing defines a plurality of terminal grooves for receiving the terminals therein correspondingly. Each of the terminals has a soldering portion exposed out of the terminal groove for being soldered to the printed circuit board by surface mounting technology (SMT).

However, the soldering portions of the terminals are exposed out of the terminal grooves for being soldered to the printed circuit board, but not fixed to the insulating housing, so they would likely be warped during soldered to the printed circuit board, which will influence the process of the SMT, and will result in an unstable connection between the conventional electrical connector and the printed circuit board.

SUMMARY OF THE INVENTION

An object of the present invention is to provide an electrical connector capable of being connected with a printed circuit board stably. The electrical connector includes an insulating housing defining a plurality of terminal grooves therein. A plurality of electric terminals is correspondingly received in the terminal grooves. Each of the electric terminals has a welded portion extending outside from a rear of the insulating housing for being soldered to the printed circuit board. A substantially inversed funnel shaped injecting portion is formed at a middle portion of the welded portion for leading liquid-state material to inject therefrom and then flow to the welded portion until the liquid-state material is solidified and integrated with the insulating housing.

As described above, the welded portions of the electric terminals are fixed to the insulating housing through the liquid-state material injecting from the injecting portion and being solidified to integrate with the insulating housing, free ends of the welded portions are not warped while soldered to the printed circuit board. So the welded portions are soldered to the printed circuit board firmly, and the electrical connection between the electrical connector and the printed circuit board is more stable.

BRIEF DESCRIPTION OF THE DRAWINGS

The present invention will be apparent to those skilled in the art by reading the following description of an embodiment thereof, with reference to the attached drawings, in which.

DETAILED DESCRIPTION OF THE PREFERRED EMBODIMENT

Figure 1:
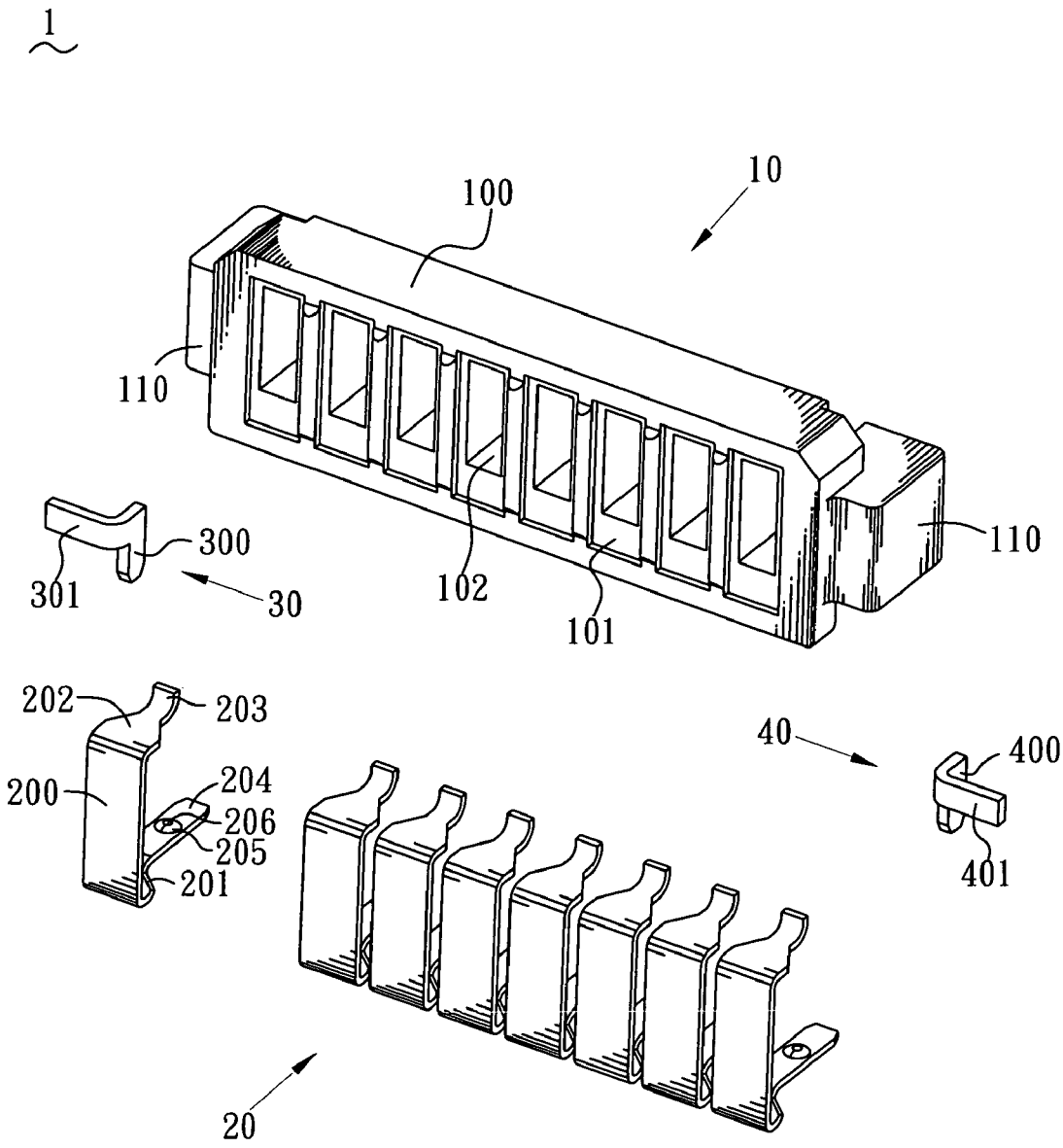
FIG. 1 is an exploded view of an electrical connector in accordance with the present invention.

With reference to FIG. 1, an electrical connector 1 according to the invention includes an insulating housing 10, a plurality of electric terminals 20, a first fixing element 30 and a second fixing element 40.

Figure 2:
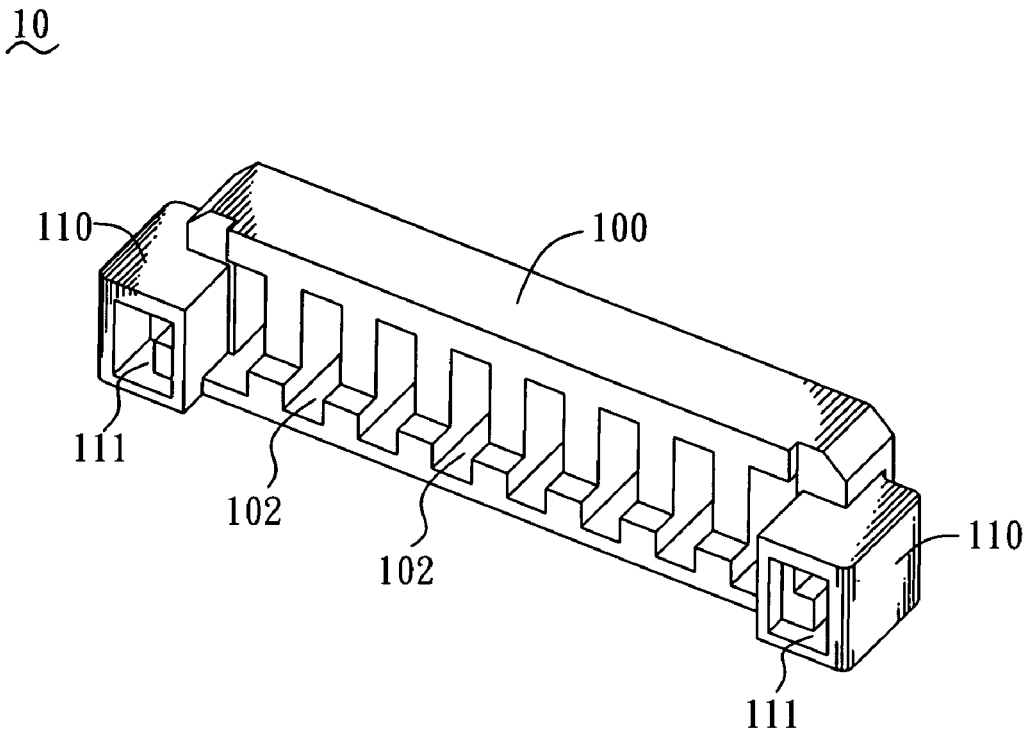
FIG. 2 is a perspective view of an insulating housing of the electrical connector.

Referring to FIG. 1 and FIG. 2, the insulating housing 10 has a substantially rectangular basic body 100. The basic body 100 defines a plurality of fixing troughs 101 at a front surface thereof. A bottom of each of the fixing troughs 101 defines a terminal groove 102 penetrating through a rear of the basic body 100. Two opposite ends of the basic body 100 respectively has a holding block 110 projecting rearward. Each holding block 110 defines a receiving cavity 111 at a rear portion thereof for correspondingly receiving the first fixing element 30 or the second fixing element 40.

Figure 3:
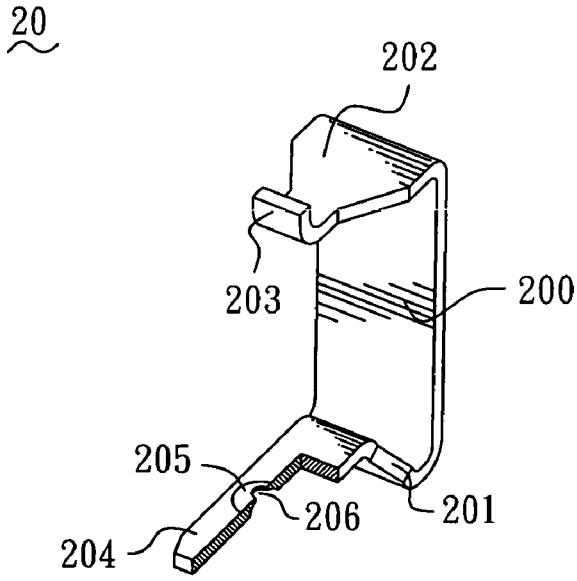
FIG. 3 is a perspective view of an electric terminal of the electrical connector with a welded portion thereof partially cut off.

Please Refer to FIG. 1 and FIG. 3, each of the electric terminals 20 has a substantially rectangular base plate 200. A bottom end of the base plate 200 bends rearward and then extends upwardly and towards the base plate 200 to form a first connecting portion 201. A top end of the base plate 200 substantially perpendicularly extends rearward to form a second connecting portion 202. A free end of the second connecting portion 202 is curled up to form an arc-shaped fixed portion 203. A welded portion 204 showing a substantial board shape extends rearward from a free end of the first connecting portion 201 to be substantially parallel to the second connecting portion 202. A substantially inversed funnel shaped injecting portion 205 is punched to be protruded from a middle portion of the welded portion 204.

Referring to FIG. 1 again, the first fixing element 30 has a first butting portion 300 disposed erectly. A first extending portion 301 substantially extends perpendicularly from a top portion of one edge of the first butting portion 300. The second fixing element 40 has a second butting portion 400 arranged erectly. A second extending portion 401 substantially perpendicularly extends from a top portion of one edge of the second butting portion 400. The first butting portion 301 and the second butting portion 401 respectively extend opposite to each other.

Figure 4:
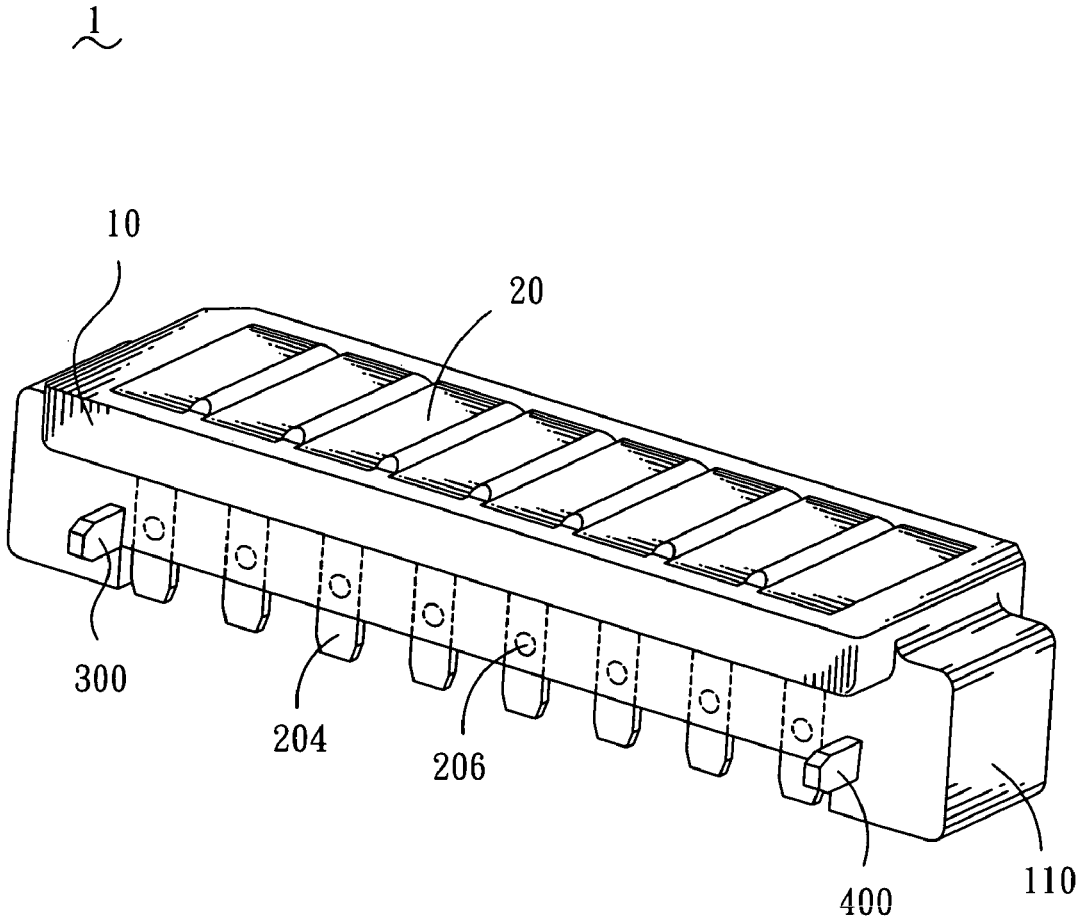
FIG. 4 is a perspective view of the electrical connector of FIG. 1.
Figure 5:
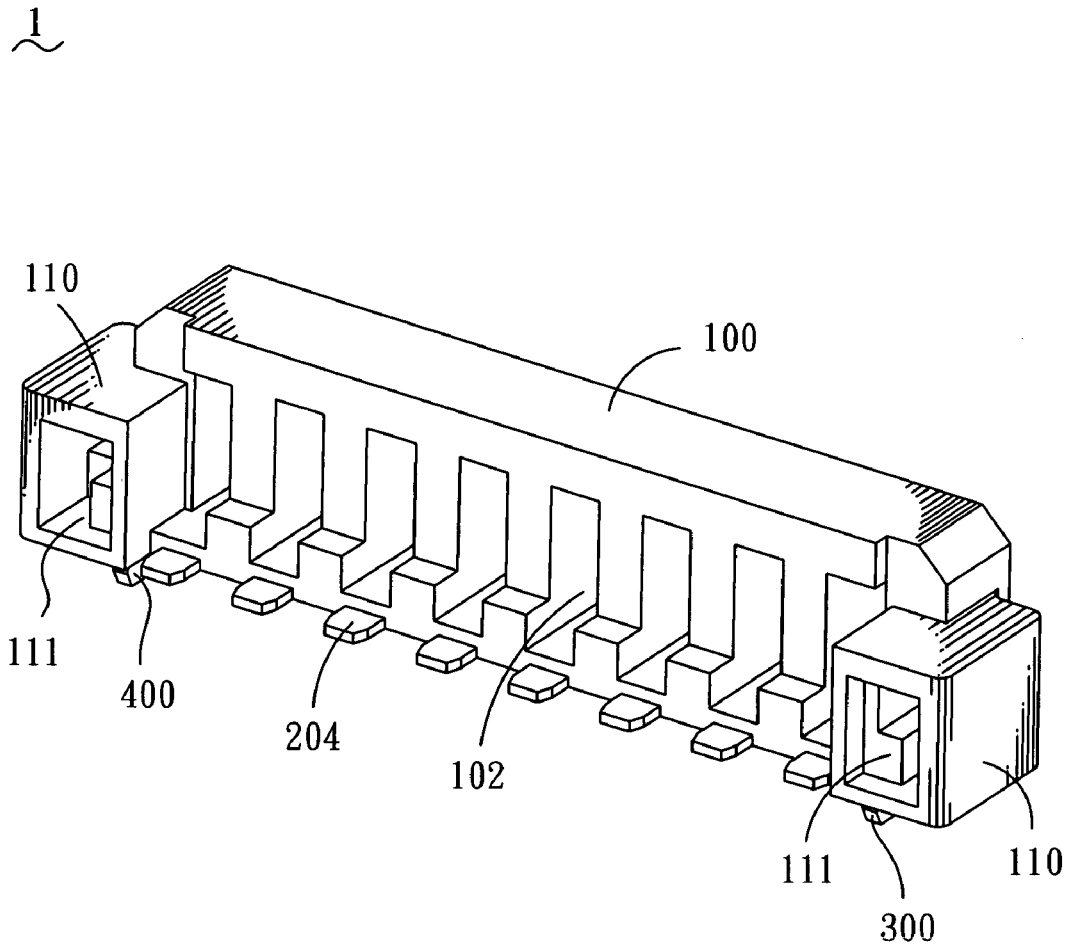
FIG. 5 is another angle perspective view of the electrical connector of FIG. 1.

Please refer to FIG. 4 and FIG. 5, in assembly, the first fixing element 30 and the second fixing element 40 are respectively fixed into the receiving cavities 111 of the holding blocks 110. Bottom ends of the first and second butting portions 300, 400 are exposed out from bottoms of the holding blocks 110 for being engaged with a mated connector (not shown). The electric terminals 20 are received in the terminal grooves 102 correspondingly. The base plates 200 are received in the fixing troughs 101 to be kept at the same level with the front surface of the basic body 100. The first and second connecting portions 201, 202, the arc-shaped fixed portions 203 and part of the welded portions 204 are embedded into the basic body 100. Free ends of the welded portions 204 extend outside from the rear of the basic body 100 for being soldered to a printed circuit board (not shown). The injecting portions 205 are also exposed outside together with the free ends of the welded portions 204.

After the electrical terminals 20 are assembled to the insulating housing 10, the liquid-state material (e.g., thermoplastic) is injected into the injecting portion 205 from a wider end thereof and then flow out from a narrower end thereof to flow to the welded portion 204 until the liquid-state material is solidified and integrated with the insulating housing 10.

When the liquid-state material is cooled and becomes solid, the welded portions 204 of the electric terminals 20 are fixed to the insulating housing 10 firmly. Thus, the free ends of the welded portions 204 are not warped while soldered to the printed circuit board, which provides convenience for the soldering process of the welded portions 204 and the printed circuit board. So the welded portions 204 are soldered to the printed circuit board firmly, and therefore, the electrical connection between the electrical connector 1 and the printed circuit board is more stable.

As the above description, the welded portions 204 of the electric terminals 20 are fixed to the insulating housing 10 through the liquid-state material injecting from the injecting portion 205 and being solidified to integrate with the insulating housing 10, the free ends of the welded portions 204 are not warped while soldered to the printed circuit board. So the welded portions 204 are soldered to the printed circuit board firmly, and the electrical connection between the electrical connector 1 and the printed circuit board is more stable.

The invention claimed is:

1. An electrical connector, comprising:

an insulating housing defining a plurality of terminal grooves therein; and a plurality of electric terminals received in the corresponding terminal grooves of the insulating housing, each of the electric terminals having a welded portion extending outside from a rear of the insulating housing for being soldered to a printed circuit board, a substantially inversed funnel shaped injecting portion being formed at a middle portion of the welded portion for holding a liquid-state material to be injected therefrom and then flow to the welded portion until the liquid-state material is solidified and integrated with the insulating housing, each electric terminal having a base plate of which a bottom end defines a first connecting portion bent rearward and then extended upwardly and towards the base plate to form a first connecting portion, a free end of the first connecting portion extends rearward to form the welded portion showing a substantially board shape.

2. The electrical connector as claimed in claim 1, wherein the injecting portion is punched to be protruded from the welded portion.

3. The electrical connector as claimed in claim 1, wherein a top end of the base plate extends rearward to form a second connecting portion substantially parallel to the welded portion, a free end of the second connecting portion is curled up to form an arc-shaped fixed portion.

4. The electrical connector as claimed in claim 1, further comprising a first fixing element and a second fixing element fixed at two opposite sides of the insulating housing, respectively.

5. An electrical connector adapted for being soldered to a printed circuit board, comprising:

an insulating housing defining a plurality of terminal grooves therein; and a plurality of electric terminals received in the corresponding terminal grooves of the insulating housing, each of the electric terminals having a welded portion extending outside from a rear of the insulating housing for being soldered to the printed circuit board, a substantially inversed funnel shaped injecting portion being formed at a middle portion of the welded portion with a diameter of an opening on one side of the welded portion being larger than a diameter of an opening on an opposing side thereof, wherein a liquid-state material is injected into the larger diameter opening of the injecting portion and then flows out from the smaller diameter opening of the injecting portion to spread to the welded portion and the insulating housing gradually for making the welded portion and the insulating housing being integrated together by the solidification thereof to leave a tail end of the welded portion being exposed outside.

6. The electrical connector as claimed in claim 5, wherein the injecting portion is punched to be protruded from the welded portion.

7. The electrical connector as claimed in claim 5, further comprising a first fixing element and a second fixing element respectively fixed at two opposite sides of the insulating housing.

8. The electrical connector as claimed in claim 5, wherein the electric terminal has a base plate of which a bottom end defines a first connecting portion bent rearward and then extended upwardly and towards the base plate to form a first connecting portion, a free end of the first connecting portion extends rearward to form the welded portion showing a substantially board shape.

9. The electrical connector as claimed in claim 8, wherein a top end of the base plate extends rearward to form a second connecting portion substantially parallel to the welded portion, a free end of the second connecting portion is curled up to form an arc-shaped fixed portion.

* * * * *